US007216522B2

(12) United States Patent
Gala

(10) Patent No.: US 7,216,522 B2
(45) Date of Patent: May 15, 2007

(54) EXTRUDING AND PIPE PRESS

(75) Inventor: Valentin Gala, Mönchengladbach (DE)

(73) Assignee: SMS Eumuco GmbH, Leverkusen (DE)

( * ) Notice: Subject to any disclaimer, the term of this patent is extended or adjusted under 35 U.S.C. 154(b) by 1 day.

(21) Appl. No.: 10/519,770

(22) PCT Filed: Jun. 12, 2003

(86) PCT No.: PCT/DE03/01929

§ 371 (c)(1),
(2), (4) Date: Jun. 23, 2005

(87) PCT Pub. No.: WO04/000538

PCT Pub. Date: Dec. 31, 2003

(65) Prior Publication Data

US 2005/0252267 A1 Nov. 17, 2005

(30) Foreign Application Priority Data

Jun. 19, 2002 (DE) ..... 102 27 488

(51) Int. Cl.
*B21C 23/00* (2006.01)

(52) U.S. Cl. ..... 72/253.1; 72/272

(58) Field of Classification Search ..... 72/253.1, 72/270, 272, 273.5
See application file for complete search history.

(56) References Cited

U.S. PATENT DOCUMENTS

| | | | | |
|---|---|---|---|---|
| 2,002,966 | A * | 5/1935 | Sparks | 72/97 |
| 2,188,076 | A * | 1/1940 | Dinzl | 72/21.2 |
| 3,695,081 | A | 10/1972 | Groos | |
| 3,919,878 | A | 11/1975 | Groos | |
| 4,570,473 | A * | 2/1986 | Huertgen | 72/255 |
| 5,062,285 | A | 11/1991 | Groos | |
| 5,421,181 | A * | 6/1995 | Ahrweiler et al. | 72/31.13 |

FOREIGN PATENT DOCUMENTS

| | | |
|---|---|---|
| EP | 0 428 989 | 5/1991 |
| EP | 0 589 240 | 4/1997 |

* cited by examiner

*Primary Examiner*—Ed Tolan
(74) *Attorney, Agent, or Firm*—Andrew Wilford

(57) ABSTRACT

A metal extrusion press has a pair of fixed crossheads spaced along a press axis from each other and a plurality of elongated upper and lower members extending axially between and rigidly connected to the crossheads. Each member includes a rod axially tensioned between the crossheads and a beam axially compressed between the crossheads. A movable crosshead is between the fixed crossheads, and a container is between the movable crosshead and one of the fixed crossheads. Respective crosshead and container guide units support the movable crosshead and container on the members and engage around the members. Rollers are engaged between each of the guide units and the members.

8 Claims, 3 Drawing Sheets

EXTRUDING AND PIPE PRESS

CROSS REFERENCE TO RELATED APPLICATIONS

This application is the US national phase of PCT application PCT/DE2003/001929, filed 12 Jun. 2003, published 31 Dec. 2003 as WO 2004/000538, and claiming the priority of German patent application 10227488.6 itself filed 19 Jun. 2002.

FIELD OF THE INVENTION

The invention relates to a rod- and tube-extrusion press having upper and lower prestressed laminated tension rods as well as upper and lower compression beams interconnecting a cylinder crosshead and a counter crosshead of a press frame and on which are mounted a movable crosshead and a movable-container into which a loader places a billet to be pressed through a die on the counter crosshead.

Such a horizontal or recumbent metal-extrusion press is known from EP 0,428,989. A billet heated in a furnace to forging temperature is picked up by loading shells and swung by arms fixed on a shaft—this being a so-called pivotal loader as opposed to a standard linear billet loader—into alignment on the press axis in the space between the die and the pressing disk. An actuating cylinder shifts the movable crosshead and the billet container toward the die so as to fit the billet container over the billet. As the billet container is advanced, the axially movable pivotal arms slide on the shaft until the block is braced between the press piston and the counter crosshead or the die mounted thereon. The containers are displaced by lateral cylinders.

The above-described rod- and tube-extrusion press is well known and performs different types of extrusion, e.g. making tubing around a fixed mandrel for instance with aluminum or making small-diameter tubing. With direct and indirect tube extrusion the billet can be punched in the press (see for example "Aluminium 49"; [1973] 4, pages 296 to 299).

With extrusion the movable crosshead and the container are normally mounted on a separate frame or on the tie elements extending between the crossheads (pressure beams, laminated beams, or combinations of compressed tubes and tie bolts) by means of slide plates and slide bushings. The latter are normally formed of bronze or plastic so that these parts wear quite a bit. This has the inevitable result that the alignment of the press must be checked often and reset and the slide or guide units have to be changed. Since this wear directly affects the service life of the tools, the quality of the product, the amount of service required, the ease of service, and the general condition of the press, for example the wear of secondary actuators, pressure plates, and the like, the guide systems are of particular significance for the general operation of the press.

These disadvantages are mitigated somewhat by making the frame of the extrusion press particularly compact to efficiently resist the press forces. The maximum forces to be resisted by the frame combine with the forces bearing on the piston of the pressing cylinder, the lateral cylinders, and the container-shifting cylinders. The use of four prestressed tension rods and four compression beams joining the cylinder crosshead and the counter crosshead reduces the deformation by more than 50% relative to constructions of standard dimensions with no prestressing. Nonetheless there is always some elastic deformation of the press frame which has an effect on the accuracy of movement of the container and of the movable crosshead as well as their slides.

OBJECT OF THE INVENTION

It is thus an object of the invention to provide a rod- and tube-extrusion press of this type without the cited disadvantages, in particular with improved operational characteristics even when greatly stressed.

SUMMARY OF THE INVENTION

This object is attained according to the invention in that the movable crosshead and the container are supported on guide units bearing with rollers on the press frame. Since the guide system has neither sliding nor wearing parts, but instead has rollers (cylinders, barrels, balls, pins, etc) that do not wear, several objects are achieved. The extrusion press needs only be aligned once when warm to hold alignment on the press axis. The guide units that can ride with their rolls on rails or rods or the like require no subsequent adjustment, the service life of the tools is increased, production quality is improved, downtime for service is less and simpler, and overall there is a substantially better mechanical operation of the rod- and tube-extrusion press.

Although it is true that the particular characteristics of roller and slide bearings as well as their different physical load-transmitting capacities are known, it is nonetheless always true that rod- and tube-extrusion presses always use slide bearings. As a result it must be concluded that rod- and tube-extrusion presses are considered inappropriate candidates for the use of roller bearings. This is the result of various mechanical realities, such as the actual width of the parts (container and movable crosshead), thermally induced dimension changes, the kinematics (speed, acceleration, cycling time, stroke), the elastic interrelationship inside the press frame, e.g. bending of the guide units, canting of the container caused by reaction forces against the actuators when moving toward the press center, and the longitudinal stretching of the compression beams. In addition there are also process-created influences, e.g. eccentric action of the pressing force as a result of irregular temperature distribution of the material being extruded or asymmetrical crushing of the billet, workpiece mushrooming, shocks, and the cleanliness of the surroundings in addition to other factors caused by construction or assembly problems, for example the position of the parts in the press frame when the guides are mounted and the levelness of the supporting surfaces on the compression beams. As a result of extensive systematic analyses of all the influencing factors it has however been determined that high-load rollers can be used in the guide units of the movable crosshead and container and allow use in a rod- and tube-extrusion press with the stated advantages.

According to a feature of the invention the rollers of the guide units ride on guide rails on the lower beams, the movable crosshead preferably being supported on two such guide units and the container on four such guide units, one or two on each of the parallel guide rails. The exact number of guide units is however always dependent on the actual requirements, for example the size of the extrusion press. The rollers can be set in an X- or O-array. The O-array as contrasted to the X-array produces greater stiffness but is more sensitive to fabrication or assembly tolerance errors.

According to a preferred embodiment of the invention the movable crosshead and the container sit via free supports on the guide units. In contrast to a differently coupled system where the movable crosshead and the container are fixed to their guide units such that they cannot move in any of the three axes (one or all three) on their guide units, this is a decoupled system. The movable crosshead and the container can move in all three directions (x, y, and z) independently of the guide units.

According to an advantageous embodiment of the invention the free supports each have a pressure plate on the respective guide unit and supporting a ball part in turn bearing via a slide plate on the respective crosshead or container. The ball part fitting in a complementary seat prevents an offset created for example by manufacturing or assembly tolerance errors while the pressure plate distributes forces on the guide units and the slide plate compensates out the axial movements of the support faces.

When according to the invention a spacer is provided between each slide plate and the cross beam or container, it is simple to adjust the height of the container or movable crosshead relative to the press axis. The spacer can for example be one or more shims or adjustment screws.

According to a proposal of the invention the free supports of the guide units are biased by springs, preferably under prestress. As a result of the spring force of, for example, a spring pack, in particular a prestressed spring pack, the container and the movable crosshead are urged pack into position when pushed out of the center of the press. The amount of prestressing force can be adjusted to shift the container or movable crosshead so that these parts are returned to position by the spring even when shifted a little. The advantageous of a prestressed rather than an unprestressed system with the same spring constants is that even with small deflections there is a high spring return force available.

BRIEF DESCRIPTION OF THE DRAWING

Further particular features of the invention are given in the claims and the following description of embodiments of the invention shown in the drawing. Therein:

SPECIFIC DESCRIPTION

Figure 1:
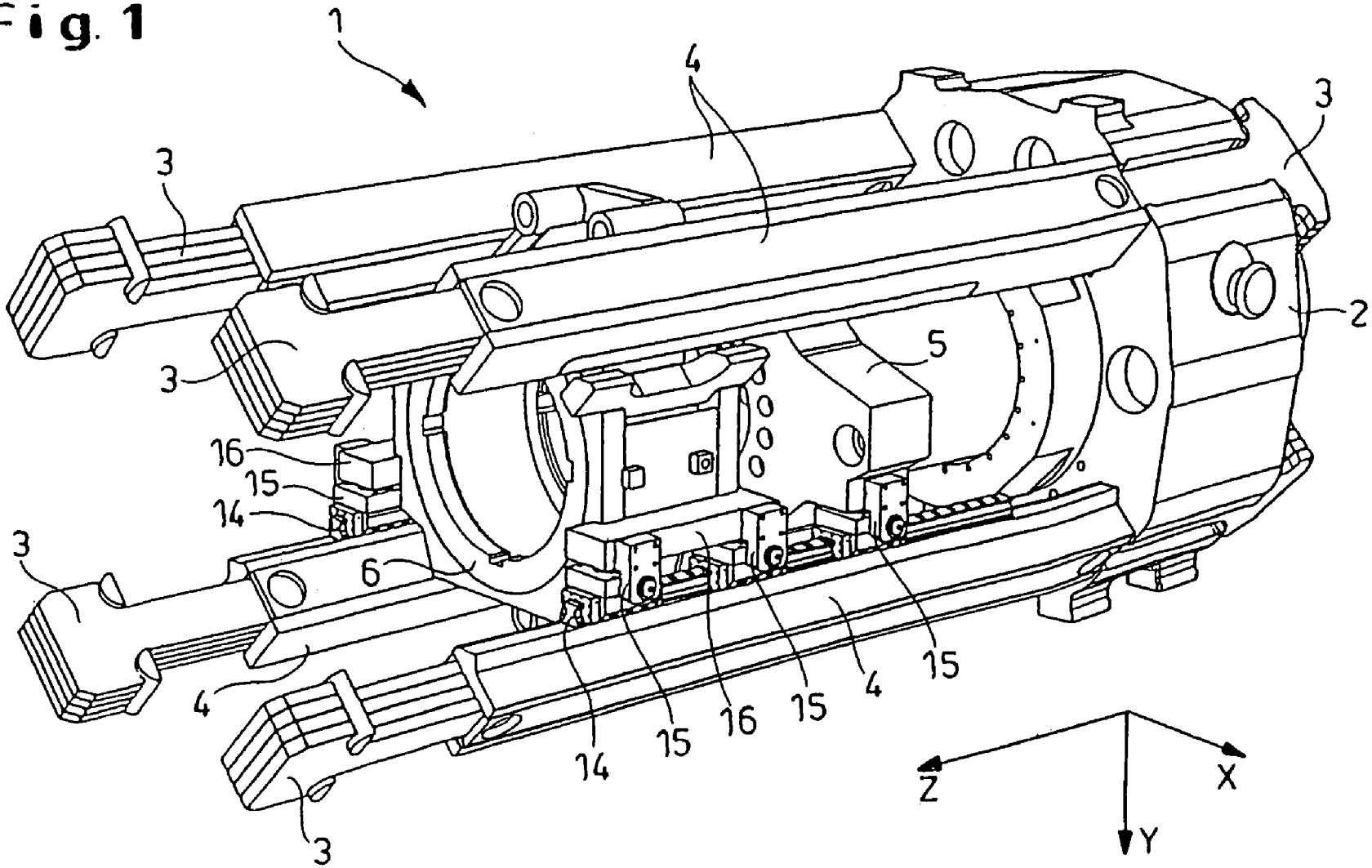
FIG. 1 is a perspective view of the frame, without the fixed crosshead, of a rod- and tube-extrusion press with a movable crosshead and a container.

The compact press frame 1 of a well known horizontal extrusion press is shown in FIG. 1. It comprises in this embodiment a cylinder crosshead 2 that is connected by four laminated tension rods 3 with an unillustrated counter crosshead provided on the left ends of the rods 3 as seen in FIG. 1. Further compression beams 4 are provided connected with these parts and surrounding the tension rods 3 between the cylinder crosshead 2 and the counter crosshead. In addition to transmitting force, the compression beams 4 also act as guides for a movable crosshead 5 and a movable container 6 in the frame 1.

Figure 4:
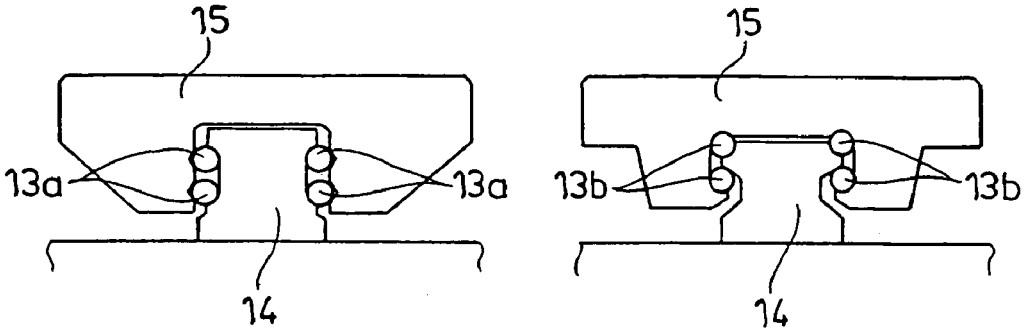
FIG. 4 is a detail of two guide units with different roller-support assemblies.
Figure 5:
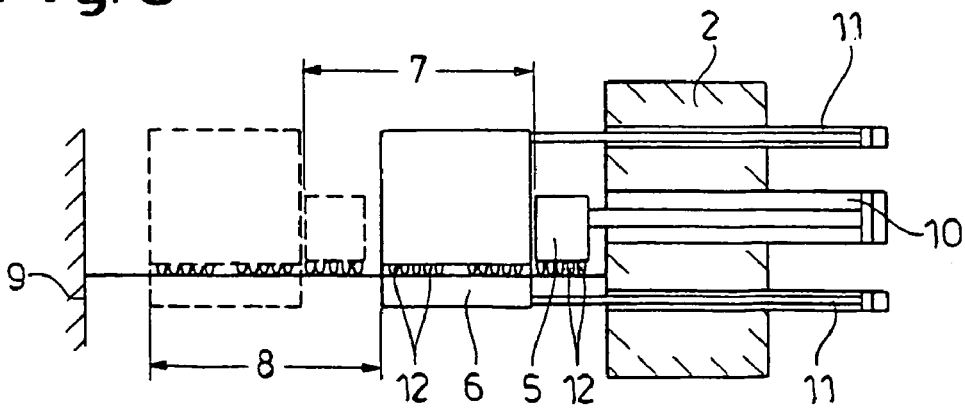
FIG. 5 is a schematic illustration of the individual strokes of the movable crosshead and container.

FIG. 5 shows the individual strokes 7 and 8 of the crosshead 5 and container 6, shown in dashed lines in their outer end positions relative to a counter crosshead shown at 9, through which strokes the crosshead 5 and container 6 are displaced by their respective drive cylinders 10 and 11. This schematic illustration clearly shows that the strokes 7 and 8 increase with increasing press size. Both the crosshead 5 and the container 6 ride via rollers 12 or 13*a*, 13*b* (see FIGS. 3 and 4) on guide rails 14 each carried on a respective one of the two lower beams 4 of the press frame 1 (see FIG. 1).

Figure 2:
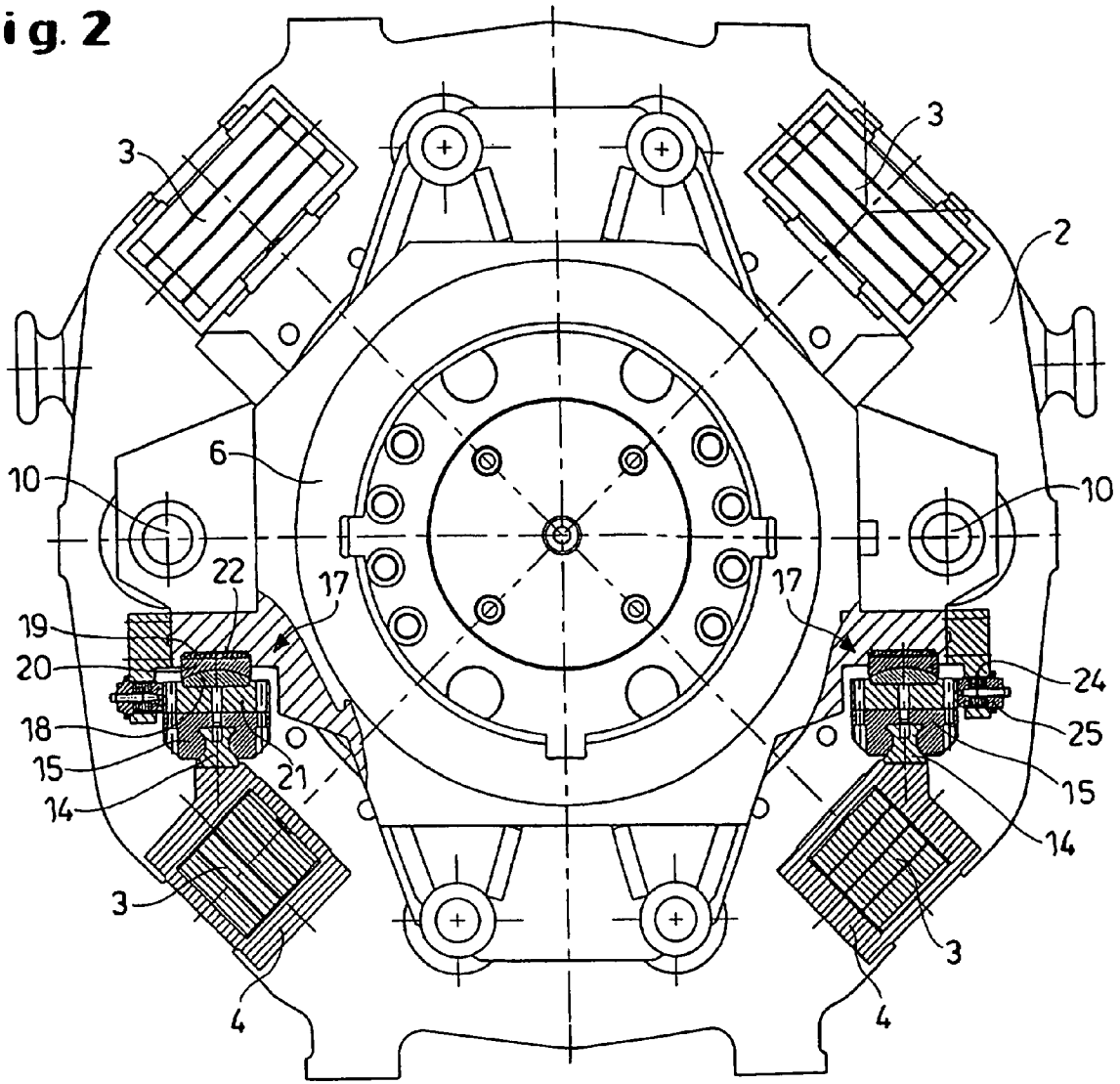
FIG. 2 is the press frame according to FIG. 1, partly in section and partly seen from the left in FIG. 1.

The rollers 12, 13*a*, and 13*b* are set in either an O-array (see the rollers 13*a* in FIG. 4) or in an X-array (see the rollers 13*b* in the right-hand part of FIG. 4) in a guide unit 15 formed as a carriage. The movable crosshead 5 is supported on the rails 14 on each side with one such guide unit 15 and the container 6 on each side with two such guide units 15 interconnected by a bridge 16. The movable crosshead 5 and the container 6 sit as shown in FIG. 2 via free supports 17 on the guide units 15, that is they are not fixed to them. The free supports 17 are each formed by a ball part 18 that fits in a complementary seat 20 supported by a slide plate 19 on the crosshead 5 (or container 6). Between the guide units 15 and the respective ball parts 18 there is also a pressure plate 21 and above the slide plate 19 there can be shims 22 by means of which it is possible to align the crosshead 5 or the container 6 with the press axis.

Figure 3:
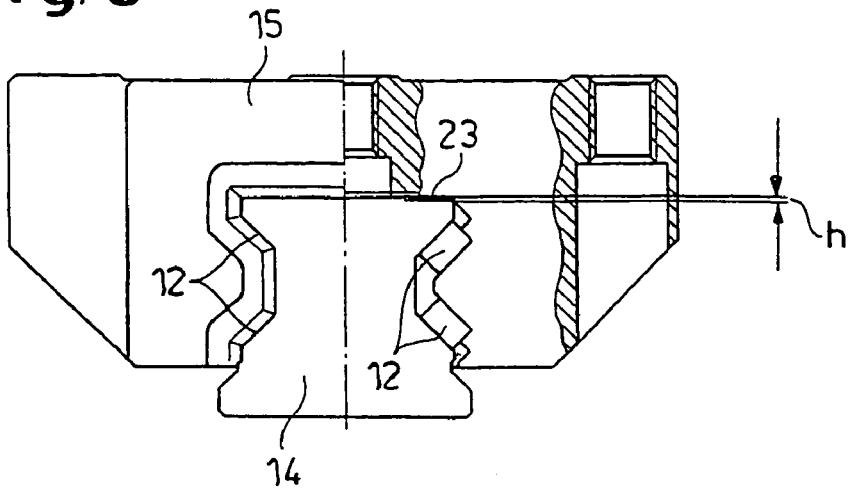
FIG. 3 is a detail of the roller support of a guide unit on a guide rail of the press frame according to FIG. 1.

In order to mitigate problems with the roller guide system that affect its service life further improvements can be made to reduce the friction between the ball parts 18 and the slide plates 19, for example by using slide plates 19 with a low coefficient of friction or supplying a lubricant, conforming the size of the slide plates 19 to the weights of the parts, reducing the effective lever action or increasing the static strength of the guide units 15 by reducing the distance between the upper side of the guide rails 14 and the inner undersides of the guide units 15 by interposition of a plate of thickness h as shown in FIG. 3.

As a result of the use of the slide plates 19 between the ball parts 18 and the crosshead 5 or the container 6 relative axial movement of the beam 4 carrying the guide rail 14 to the crosshead 5 or container 6 can be tolerated. This movement can be the result of thermal deformation of the machine parts, of the elastic deformation of the press frame 1 as a result for example of axial forces applied to the container 6 from contact of the pressing disk in the container passage when not perfectly aligned. In order to reset the movable crosshead 5 and the container 6 back into the press center, the free supports 17 of the guide units are acted upon by spring packs 24 that can be imparted any desired spring constant by adjustment nuts 25.

The invention claimed is:

1. A metal extrusion press comprising:

a pair of fixed crossheads spaced along a press axis from each other;

a plurality of elongated upper and lower members extending axially between and rigidly connected to the crossheads, each member including a rod axially tensioned between the crossheads and a beam axially compressed between the crossheads;

a movable crosshead between the fixed crossheads;

a container between the movable crosshead and one of the fixed crossheads;

respective crosshead and container guide units supporting the movable crosshead and container on the members and engaging around the members; and rollers engaged between each of the guide units and the members.

2. The extrusion press defined in claim 1 wherein the rollers and guide units are provided only on the lower members.

3. The extrusion press defined in claim 2 wherein there are two such lower members, two such crosshead guide units, and four such container guide units.

4. The extrusion press defined in claim 1 wherein each unit includes upper and lower horizontally relatively shiftable support elements, the upper elements of the crosshead and container units being carried on the movable crosshead and the container, the lower elements bearing via the respective rollers on the respective members.

5. A metal extrusion press comprising:

a pair of fixed crossheads spaced along a press axis from each other;

a plurality of elongated upper and lower members extending axially between and rigidly connected to the crossheads, each member including a rod axially tensioned between the crossheads and a beam axially compressed between the crossheads;

a movable crosshead between the fixed crossheads;

a container between the movable crosshead and one of the fixed crossheads;

respective upper support elements horizontally sliceable on the crosshead and container units and each formed with a downwardly concave ball seat;

respective lower support elements underneath the upper support elements and each having an upwardly convex ball surface fitted in the respective seat, whereby each lower support element with the respective upper element supports the crosshead and container on the members; and rollers engaged between each of the lower support elements and the members.

6. The extrusion press defined in claim 5, further comprising spacers between the upper elements of the crosshead and container units and the movable crosshead and container.

7. The extrusion press defined in claim 5, further comprising respective spring means braced horizontally between the movable crosshead and the container for horizontally urging the crosshead and container units into predetermined positions relative to the movable crosshead and container.

8. The extrusion press defined in claim 7 wherein the spring means are prestressed.

* * * * *